US005210902A

United States Patent [19]

Lee et al.

[11] Patent Number: 5,210,902

[45] Date of Patent: May 18, 1993

[54] VACUUM CLEANER

[75] Inventors: Young C. Lee; Seong B. Lee; Deok K. Park, all of Seoul, Rep. of Korea

[73] Assignee: Goldstar, Co., Ltd., Seoul, Rep. of Korea

[21] Appl. No.: 706,932

[22] Filed: May 29, 1991

[30] Foreign Application Priority Data

May 31, 1990 [KR] Rep. of Korea ..... 8008/1990

[51] Int. Cl.[5] ..... A47L 5/36; A47L 7/00

[52] U.S. Cl. ..... 15/321; 15/322; 15/347; 15/353

[58] Field of Search ..... 15/321, 353, 347, 322

[56] References Cited

U.S. PATENT DOCUMENTS

| | | | |
|---|---|---|---|
| 3,048,876 | 8/1962 | Kemnitz | 15/321 |
| 3,431,582 | 3/1969 | Grave | 15/353 X |
| 3,490,208 | 1/1970 | Meyer et al. | 55/356 |
| 3,942,217 | 3/1976 | Bates | 15/353 X |
| 3,958,298 | 5/1976 | Cannon | 15/322 |
| 4,078,908 | 3/1978 | Blackman | 15/353 X |
| 4,122,579 | 10/1978 | Parise | 15/353 |
| 4,226,000 | 10/1980 | Tribolet | 15/321 |
| 4,234,995 | 11/1980 | Parise | 15/322 |
| 4,586,208 | 5/1986 | Trevarthen | 15/353 X |
| 5,075,920 | 12/1991 | Salmon | 15/322 X |

*Primary Examiner*—Chris K. Moore

*Attorney, Agent, or Firm*—David E. Lovejoy

[57] ABSTRACT

A vacuum cleaner which is able to be used for water extraction cleaning and for dry suction cleaning. The cleaner comprises a dry suction cleaning device and a water extraction cleaning device which are movable individually under the connected condition thereof. The water extraction cleaning device includes an air-liquid separation surface such that air and liquid impinge against the air-liquid separation surface, thereby causing entrained liquid droplets to be separated from the incoming air, a second air-liquid separation surface disposed at downstream of the first separation surface such that air and liquid past the first separation surface impinge against the second air-liquid separation surface, thereby causing small droplets to be separated from air. The present vacuum cleaner perfectly prevents water from incoming toward a motor, that is a suction device and effectively cleans smooth flat floors as well as carpet, when used for water extraction cleaning.

16 Claims, 8 Drawing Sheets

VACUUM CLEANER

BACKGROUND OF THE INVENTION

The present invention relates to a vacuum cleaner, and particularly to a vacuum cleaner which is able to be used for water extraction cleaning and for dry suction cleaning.

An example of conventional dry and wet type vacuum cleaners enabling both water extraction cleaning and dry suction cleaning is disclosed in U.S. Pat. No. 4,218,805. The vacuum cleaner is of the upright-type which includes a main container having an open top closed by a top cover assembly with the interposition of either a reservoir if the cleaner is to be used for water extraction cleaning, or a dust filter assembly if it is to be used for dry suction cleaning. To facilitate separation of entrained liquid droplets from the incoming air when the vacuum cleaner is used for water extraction cleaning, a downwardly extending annular wall is provided in the interior of main container near an air inlet. In this arrangement, the incoming air is impinged against the surface of annular wall, so that heavy droplets can drop to be collected in the main container, while light air together with dust can rise up to a dust filter assembly. The rising air impinges against a downwardly inclining frusto-conical inner wall again, in order to separate any possibly entrained small droplets from the air. Although performing properly in the case of water extraction cleaning for carpet, such cleaner has a disadvantage of poor performance for water extraction cleaning for a smooth flat floor. Furthermore, splashing may be generated when droplets drop in the main container. Because the conical inner wall is arranged directly beneath the air outlet communicating with a motor and a suction device, the splashed small droplets may be entrained in the rising air again and then sucked into an impeller of the motor, thereby causing contaminated water to be discharged into the room.

The other example of conventional dry and wet type vacuum cleaners enabling both water extraction cleaning and dry suction cleaning is disclosed in EP 0245873. The cleaner is shown in FIGS. 15 and 16. As shown in the drawings, the cleaner 100 is of the horizontal-type which includes a chamber 103 disposed at the front and selectively receiving either a filter assembly 101 (FIG. 15) or a contaminated liquid container 102 (FIG. 16), and a motor 104 and a suction device at the rear. When the cleaner 100 is to be used for water extraction cleaning, air incoming into the cleaner 100 flows upwardly through a passage 105 upwardly extending to the liquid container 102 and impinges against the inner surface of upper wall 106 of liquid container 102, so that heavy droplets can drop to be collected in the liquid container 102, while light air together with dust can flow through an air passage 107 extending downwardly from its inlet near the upper wall 106 to the motor 104. However, such a conventional cleaner also has a disadvantage of poor performance for water extraction cleaning for a smooth flat floor, because of its design for water extraction cleaning for a carpet. Furthermore, there is a problem that droplets tend to come into the motor 104 through the air passage 107, since the inlet of air passage 107 is disposed near the inner surface of upper wall 106 against which droplets impinge. In this cleaner, the lower outlet 109 of the liquid detergent chamber 108, disposed beneath the contaminated liquid chamber 102, is connected with the liquid detergent inlet 110 provided at the bottom of chamber 103. If the connection becomes poor, there is a problem that liquid detergent leaks from the poor connection portion and undesirably collects on the bottom of chamber 103. In addition, operations for reversing from dry suction cleaning to water extraction cleaning or vice versa are troublesome.

SUMMARY OF THE INVENTION

Therefore, an object of the present invention is to eliminate the above-mentioned disadvantages encountered in the prior art and to provide a vacuum cleaner which can prevent water from coming into a suction motor and effectively clean smooth flat floors as well as carpet.

Another object of the present invention is to provide a vacuum cleaner enabling simple and easy reversion operations from dry suction cleaning to water extraction cleaning and vice versa.

Another object of the present invention is to provide a vacuum cleaner which can utilize existing dry vacuum cleaners as one of the constituting elements of the present invention, without any modification.

In accordance with the present invention, these objects can be accomplished by providing a vacuum cleaner including a cleaning head including a cleaning head body having front and rear walls, a top wall and opposite side walls, said rear wall being provided with an outlet at the center of an upper portion thereof; a hose assembly connected at one end thereof to the outlet of the cleaning head and provided with an air passage therein. The cleaner includes a liquid detergent tube having one end disposed within the cleaning head; The clearer includes a dry suction cleaning device including an inlet to which the other end of the hose assembly is directly connectable, and a motor generating an air suction force and a filter assembly for filtering dust from air sucked into the interior of the dry suction cleaning device. The cleanor includes a water extraction cleaning device including an inlet to which the other end of the hose assembly is connectable, an outlet to which a hose is connected at one end thereof, hose having the other end connectable to inlet of the dry suction cleaning device. The cleaner includes a main chamber collecting contaminated liquid incoming through the inlet of the water extraction cleaning device and of a liquid detergent chamber having an outlet connected to the other end of the liquid detergent tube.

Other objects and features of the present invention will be apparent from the following description and accompanying drawings showing preferred embodiments of the invention.

DETAILED DESCRIPTION OF THE PREFERRED EMBODIMENTS

Figure 1:
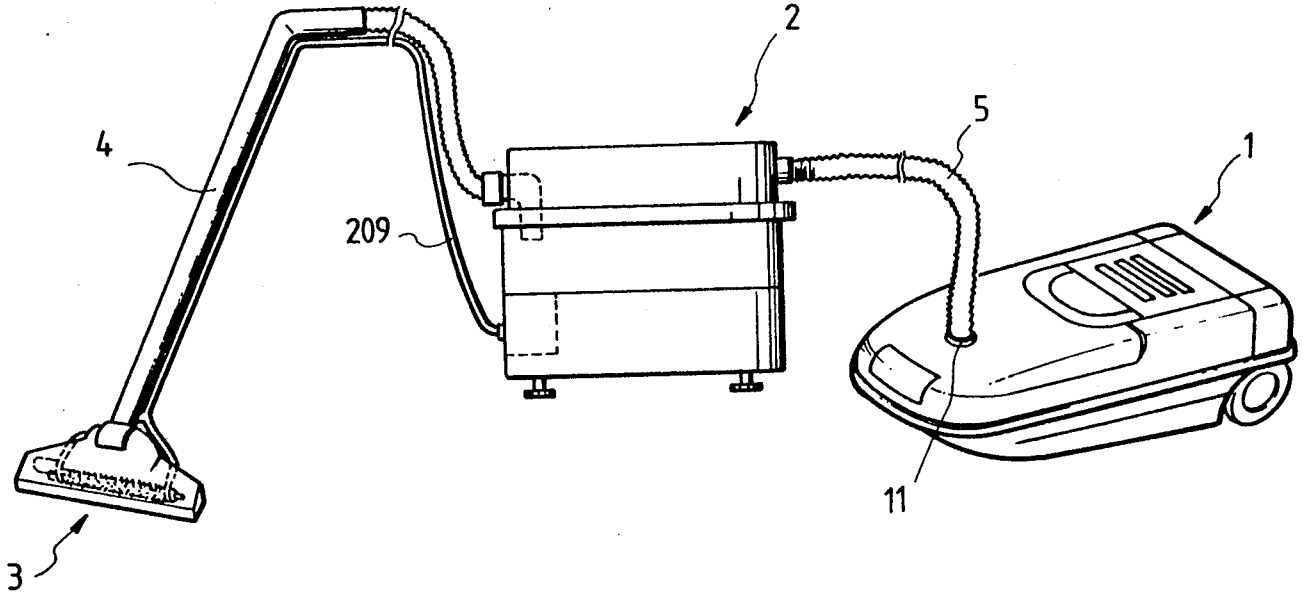
FIG. 1 is a schematic perspective view of a vacuum cleaner in accordance with the present invention.
Figure 2:
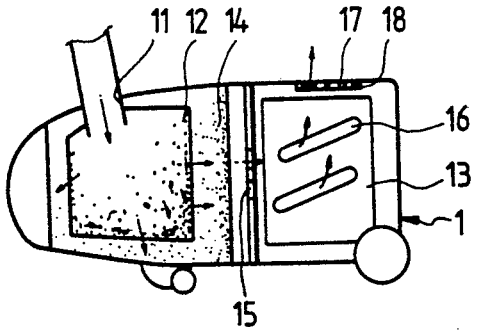
FIG. 2 is partially-broken schematic side view of a dry suction cleaning device in accordance with the present invention.

Referring to FIG. 1, there is shown a vacuum cleaner in accordance with the present invention. The shown vacuum cleaner comprises a dry suction cleaning device 1, a water extraction cleaning device 2, and a cleaning head 3. As shown in FIG. 2, the dry suction cleaning device 1 includes an air inlet 11 to which either one end of a hose assembly 4 connected to the cleaning head 3 or one end of a hose 5 connected to an outlet of the water extraction cleaning device 2 (In FIG. 2, there is shown the former case), a paper filter 12 for filtering air incoming through the air inlet 11, and a motor 13 generating air suction force. In the drawing, reference numeral 14 designates an air receiving bag, 15 a suction inlet port, 16 an outlet port, 17 a discharging port, and 18 a static electricity filter. The above construction of dry suction cleaning device 1 is well-known, and thus a detailed description thereof will be omitted.

Figure 3A:
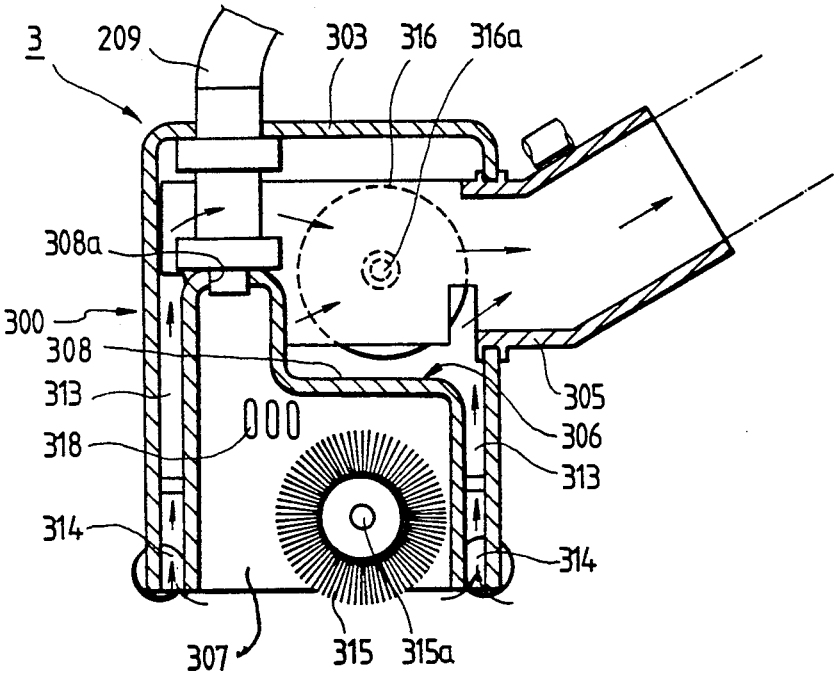
FIG. 3A is a sectional view of a cleaning head in accordance with an embodiment of the present invention.
Figure 3B:
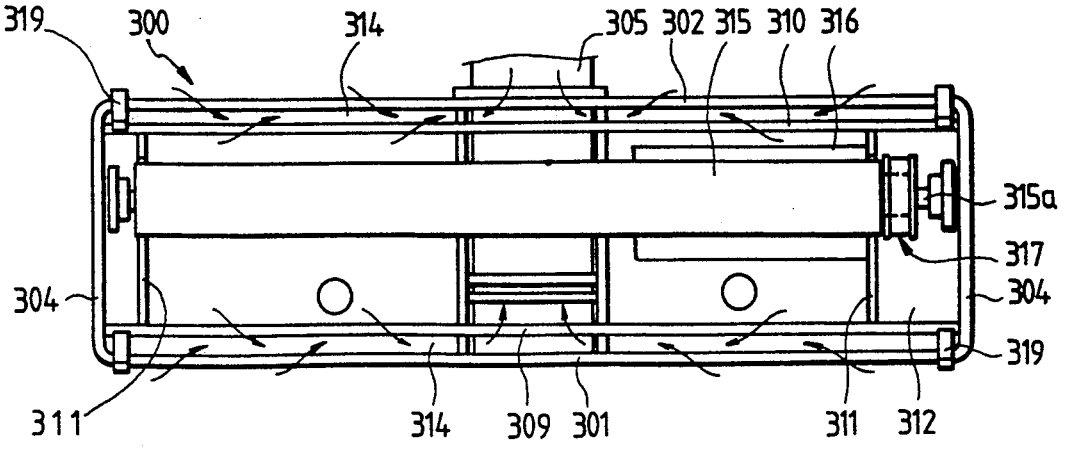
FIG. 3B is a bottom view of the cleaning head shown in FIG. 3A.

FIGS. 3A and 3B show a cleaning head 3 in accordance with the present invention. The cleaning head 3 comprises a bottom-opened cleaning head body 300 including front and rear walls 301 and 302, a top wall 303, and opposite side walls 304. An outlet 305 is provided at the center of the upper portion of rear wall 302. Within the cleaning head body 300, a partition 308 defining a cleaning chamber 307 therein is disposed. The partition 306 comprises a top wall 308 having a hole 308*a* receiving one end of a liquid detergent tube 209 such that the and is protruded into the cleaning chamber 307, front and rear walls 309 and 310 inwardly spaced from front and rear walls 301 and 302 of the cleaning head body 300, respectively, and opposite side walls 311 one being spaced from one side wall 304 of the cleaning head body 300 to define a space 312 therebetween, the other being constituted by a portion of the other side wall 304 of the cleaning head body 300. An air and liquid suction passage 313 is defined between the inner surface of cleaning head body 300 and the outer surface of partition 306. Also, a pair of laterally extending air and liquid suction inlets 314 are defined between the lower end edge of the front wall 301 of cleaning head body 300 and the lower end edge of the front wall 309 of partition 306 and between the lower end edge of the rear wall 302 of the cleaning head body 300 and the lower end edge of the rear wall 310 of partition 306, respectively. Within the cleaning chamber 307, a brush 315 is rotatably mounted, which includes a rotating shaft 315*a* having one end disposed in the space 312 defined between one side wall 304 of cleaning head body 300 and one side wall 311 of partition 306.

Directly above the brush 315 and within the air and liquid passage 313, a motor 316 generating drive force for rotating the brush 315 is mounted. The end of drive shaft 316*a* of the motor 316 is also disposed within the space 312. In order to transmit the drive force of motor 316 to the brush 315, a pulley and belt assembly 317 is provided in the space 312 and operatably connected with both the end of rotating shaft 315*a* and the end of drive shaft 316*a*.

In order to prevent the cleaning chamber 307 from being under the vacuum condition, a communication port 318 which connects the chamber 307 to the external atmosphere is provided at the partition side wall constituted by a portion of the side wall 304 of cleaning head body 300.

Wheels 319 are rotatably mounted on four corners of the bottom of cleaning head body 300.

When the cleaning head 3 of the above construction operates for water extraction cleaning, the brush 315 rotates by the drive force from the motor 316. By the operation of the liquid detergent pump 207 contained in the water extraction cleaning device 2, liquid detergent is supplied in the cleaning chamber 307 through the outlet of tube 209. Cleaning is carried out by the rotation of brush 315. At this time, dust and contaminated liquid on the floor are sucked from air and liquid suction ports 314 by the suction force generated from the motor 13 of the dry suction cleaning device 1, past sequentially the air and liquid suction passage 313, the outlet 305 and the hose assembly 4, to the water extraction cleaning device 2. In the case of cleaning as the cleaning head 3 moves forwardly, the front suction port 314 functions to suck dry dust, while the rear suction port 314 functions to suck contaminated liquid produced by cleaning using liquid detergent. On the other hand, in the case of cleaning as the cleaning head 3 moves rearwardly, the front suction port 314 functions to suck contaminated liquid, while the rear suction port 314 functions to suck dry dust. In the case of dry suction cleaning, the cleaning head operates in the same manner as that of the cleaning head of a conventional dry suction cleaner.

Figure 4A:
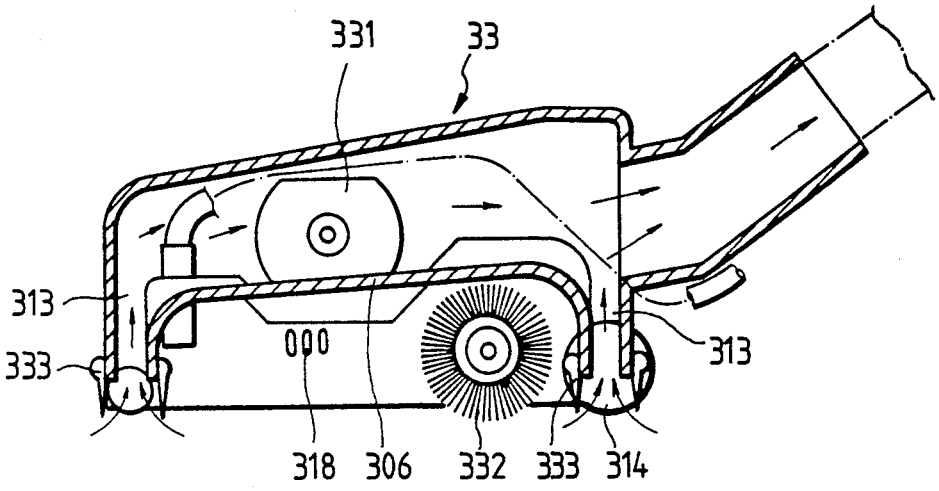
FIG. 4A is a sectional view of a cleaning head in accordance with the other embodiment of the present invention.
Figure 4B:
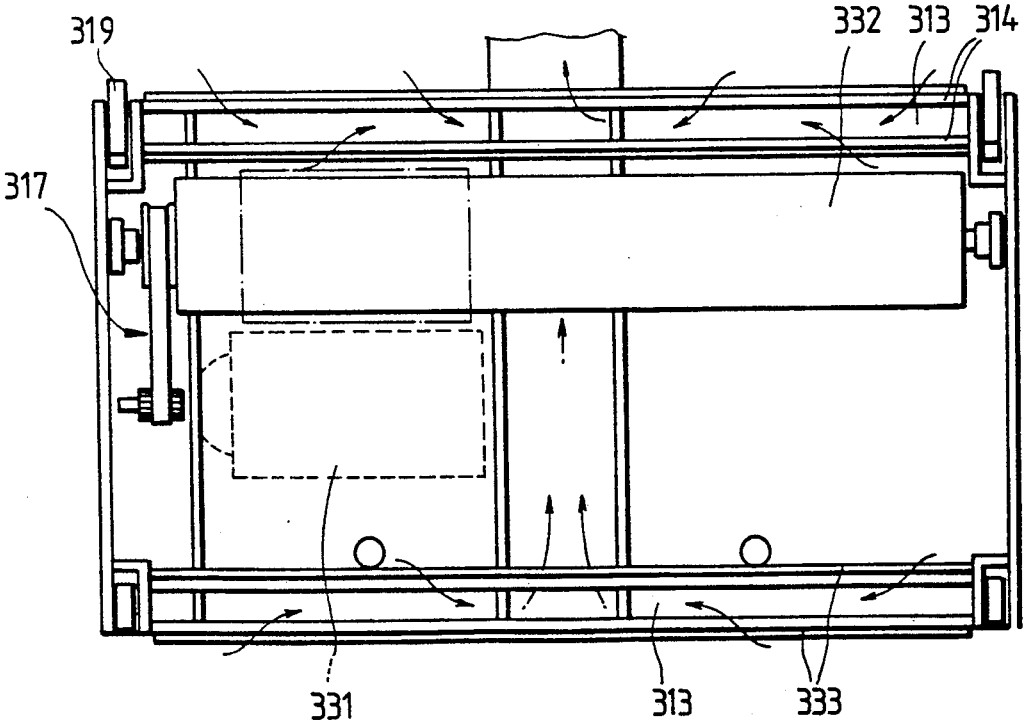
FIG. 4B is a bottom view of the cleaning head shown in FIG. 4A.

Referring to FIGS. 4A and 4B, there is shown a cleaning head 33 in accordance with the other embodiment of the present invention. The cleaning head 33 of this embodiment is wider and lower than that of the above-mentioned embodiment. In the present case, motor 331 is not disposed directly above the brush 332, but disposed at the front thereof. To edges defining the air and liquid suction ports 314, rubber plates 333 are attached which extend over the length of the edges, respectively. Other constructions are identical or similar to those of the previous embodiment, and thus no description thereof is made.

Figure 5:
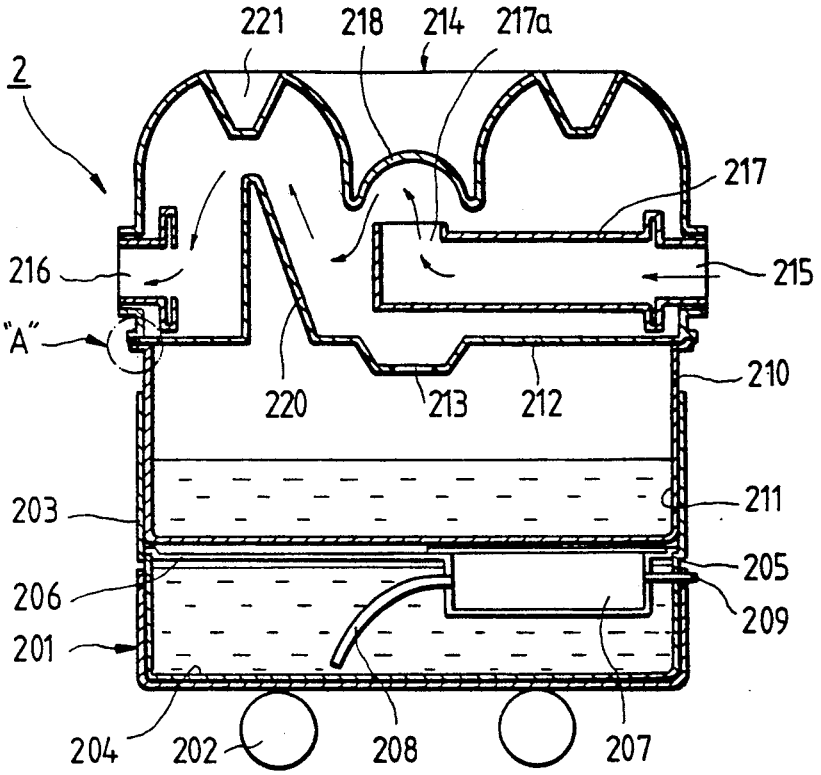
FIG. 5 is a schematic sectional view of a water extraction cleaning device in accordance with an embodiment of the present invention.
Figure 6:
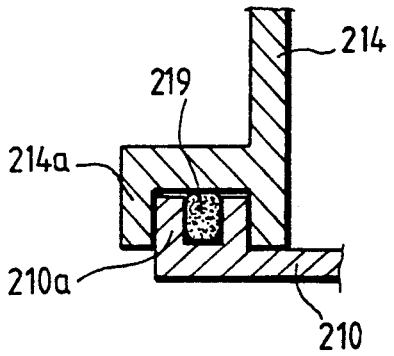
FIG. 6 is an enlarged view of the portion A of FIG. 5.

FIG. 5 shows a water extraction cleaning device 2 in accordance with an embodiment of the present invention. The device 2 includes a cylindrical base 201 to which wheels 202 are rotatably attached. Within the base 201, a cylindrical liquid detergent container 203 is closely fitted. The container 203 has a lower portion defining a liquid detergent chamber 204 and an upper portion of the diameter slightly larger than that of the lower portion. A step 205 is formed at the immediate portion between the lower and upper portions of the container 203. On the step 205, a support plate 206 is supported. A liquid detergent pump 207 to which liquid detergent receiving and discharging tubes 208 and 209 are connected is attached to the bottom of the support plate 206. In the upper portion of liquid detergent container 203, a cylindrical main container 210 is closely fitted, which defines a main chamber 211 collecting contaminated liquid therein. On the upper end of the main container 210, a circular cover plate 212 having a particular construction according to the present invention is detachably mounted. A contaminated liquid inlet 213 is formed at the center of the cover plate 212. On the other hand, a cover unit 214 is disposed on the cover plate 212. The cover unit 214 includes an air and liquid inlet 215 connected with the end of the hose assembly 4, which is connected to the cleaning head 3, and adapted for receiving contaminated air and liquid, and an air outlet 216 disposed opposite to the inlet 215. To the air outlet 216, a hose 5 connected with the air inlet 11 of the dry suction cleaning device 1 is connected. In order to prevent any leakage of the contaminated liquid to external, the cover unit 214 is provided at its lower end peripheral edge with a grooved coupling 214*a* and the main container 210 is provided at its upper end peripheral edge with a seal ring-loaded coupling 210*a* which is fitted in the groove, as shown in FIG. 6. The seal ring is designated by reference numeral 219. Within the cover unit 214, a deflecting pipe 217, which extends to the center of the interior of cover unit 214 and has an upwardly opened outlet 217*a*, is mounted to the inlet 215. To facilitate separation of entrained liquid droplets from the incoming air through the inlet 215, the cover unit 214 includes an air-liquid separation surface 218 disposed near and directly above the outlet 217*a* of deflecting pipe 217. Accordingly, air and liquid upwardly projecting through the outlet 217*a* of deflecting pipe 217 impinge against the air-liquid separation surface 218, so that liquid can be separated from air. The separated liquid is received in the main container 210, through the liquid inlet 213 of cover plate 212, while air flows toward the air outlet 216. At this time, the air may includes small droplets which were not separated therefrom by the air-liquid separation surface 218. In order to completely separate these small droplets from air, there is a second air-liquid separation surface 220 at downstream of the separation surface 218. The separation surface 220 is comprised of a sharply inclined surface formed by upwardly extending a portion of the cover plate 212 to the height higher than that of the peripheral edge of first separation surface 218. In order to more facilitate the separation of entrained droplets from air, the cover unit 214 has a downwardly extending protrusion 221 disposed near the second separation surface 220. Past the second separation surface 220 and the protrusion 221, air flows toward the air inlet 11 of the dry suction cleaning device 1, via the air outlet 216 of the cover unit 214.

Figure 7:
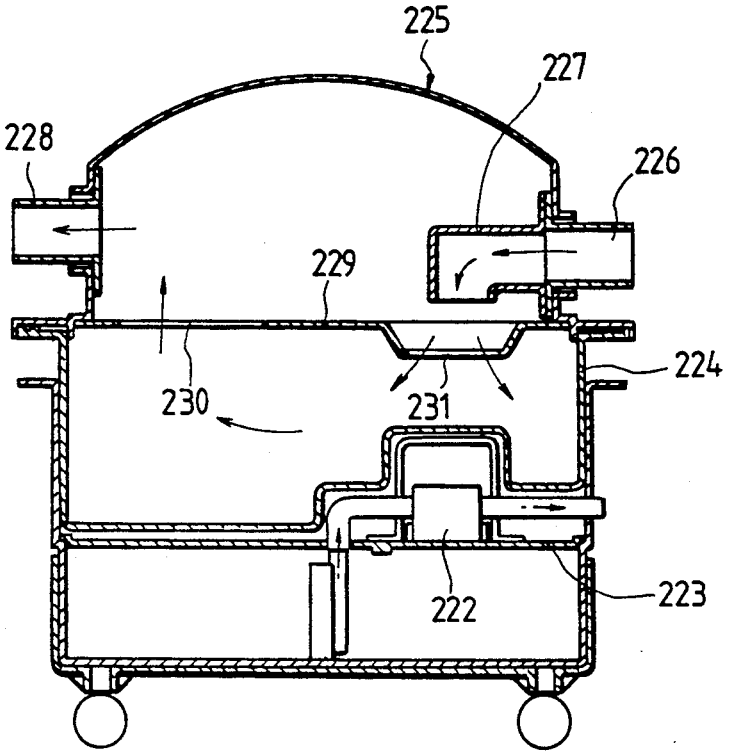
FIG. 7 is a schematic sectional view of a water extraction cleaning device in accordance with the other embodiment of the present invention.
Figure 8:
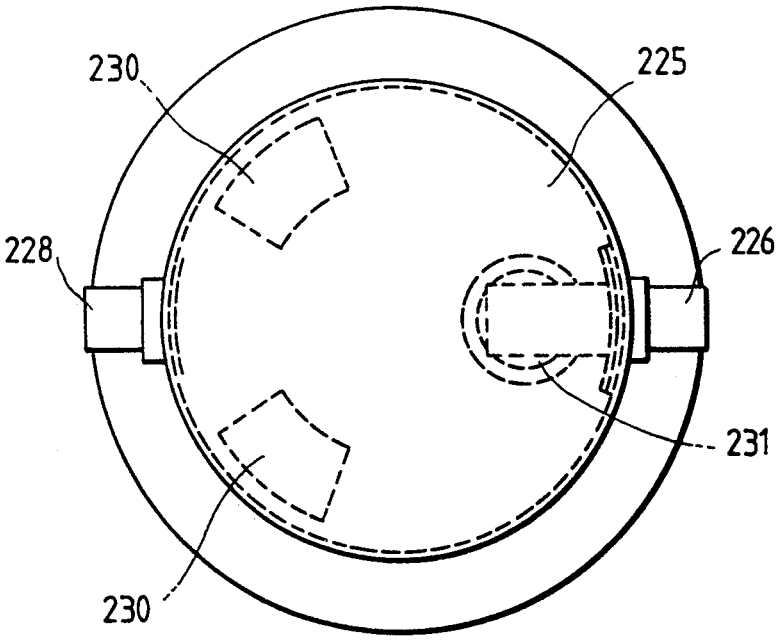
FIG. 8 is a plan view of the water extraction cleaning device shown in FIG. 7.

Referring to FIGS. 7 and 8, there is shown a water extraction cleaning device in accordance with the other embodiment of the present invention. In this embodiment, the constructions of base and liquid detergent container are substantially similar to those in the previous embodiment. In the present case, a liquid detergent pump 222 is supported on the upper surface of a support plate 223. In this connection, main container 224 has the bottom construction providing a space for containing the pump 222 therein. There is also a deflecting pipe 227 attached to the inlet 226 of the cover unit 225, which pipe is of shorter length and has a downwardly opened outlet 227*a*. Distinguished from the previous embodiment, the present embodiment includes no air-liquid separation surface, but includes at least one air outlet 230 formed at cover plate 229 near the air outlet 228 of the cover unit 225. In this arrangement, air and liquid projecting through the outlet 227*a* of deflecting pipe 227 incomes directly into the main container 224, through the inlet 231 of the cover plate 229. At this time, light air rise up through the outlets 230 of the cover plate 229 to the interior of cover unit 225. Thus, separation of liquid from air is accomplished.

Figure 9:
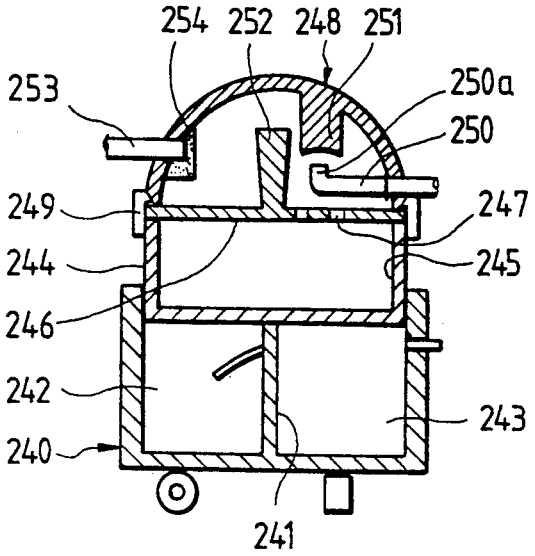
FIG. 9 is a sectional view of a water extraction cleaning device of the other embodiment of the present invention.
Figure 10:
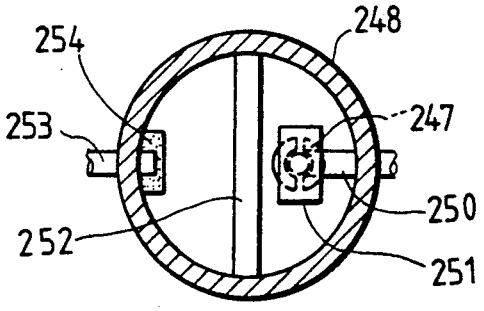
FIG. 10 is a broken-out plan view of the water extraction cleaning device shown in FIG. 9.

FIGS. 9 and 10 show a water extraction cleaning device in accordance with another embodiment of the present invention. The device of this embodiment include a base 240 the interior of which is divided by a partition member 241 into a liquid detergent chamber 242 and a liquid detergent pump 243. In the upper portion of base 240, a main container 244 is closely fitted, which defines a main chamber 245 therein. A cover plate 246 having arcuate air and liquid inlets 247 is separably mounted to the upper end of the main container 244. To the upper end of the main container 244, a cover unit 248 is also detachably mounted by means of hook members 249. Directly above outlet 250*a* of deflecting pipe 250, an extension 251 extends downwardly from the inner surface of the top portion of cover unit 248. The concave bottom surface of the extension 251 has the same function as that of the first air-liquid separation surface in the embodiment of FIG. 5. Also, a second extension 252 extends upwardly from the center of the cover plate 246 to the height above the bottom surface of the first extension 251, the side surface of second extension 252 has the same function as that of the second air-liquid separation surface in the embodiment of FIG. 5. In the present embodiment, a filter 254 is attached to air outlet 253 of cover unit 248, so that no droplets are entrained in air incoming into the dry suction cleaning device 1.

Figure 11:
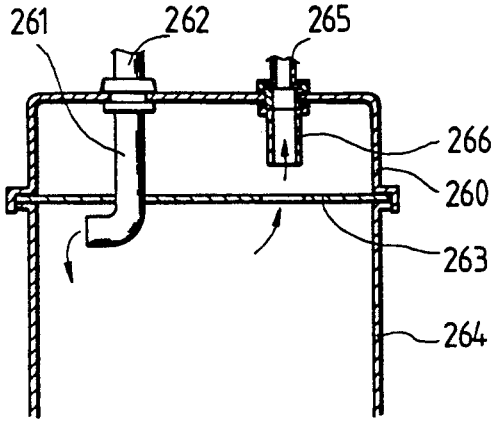
FIG. 11 is a partial sectional view of a water extraction cleaning device in accordance with another embodiment of the present invention.
Figure 12:
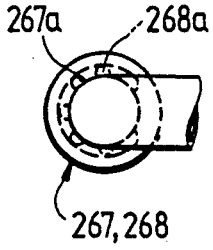
FIG. 12 is a plan view showing the pipe connection according to the present invention.

Referring to FIG. 11, there is shown a water extraction device in accordance with another embodiment of the present invention. This embodiment comprises a downwardly extending deflecting pipe 261 having one end connected to an air and liquid inlet 262 formed at the top portion of cover unit 260 and the other end disposed in main container 264, and an air discharging pipe 266 having an inlet disposed in the cover unit 260. Mounting of the deflecting pipe 261 and the air discharging pipe 266 is accomplished by the provision of a male member 267 provided at its peripheral surface with a plurality of spaced protrusions 267*a* and a mating female member 268 provided with a plurality of grooves 268*a* receiving respective protrusions 267*a* of said male member 267 and preventing the male member 267 from being separated out of said female member 268.

Figure 13:
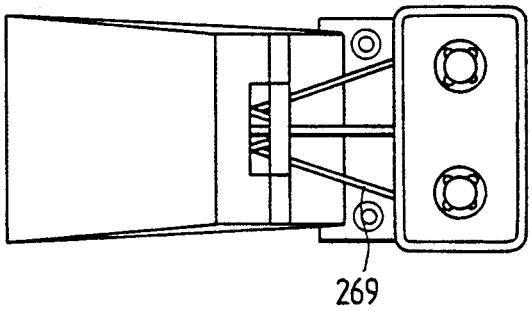
FIG. 13 is a plan view of a vacuum cleaner according to the present invention, showing a hook attaching a dry suction cleaning device to a water extraction cleaning device.
Figure 14:
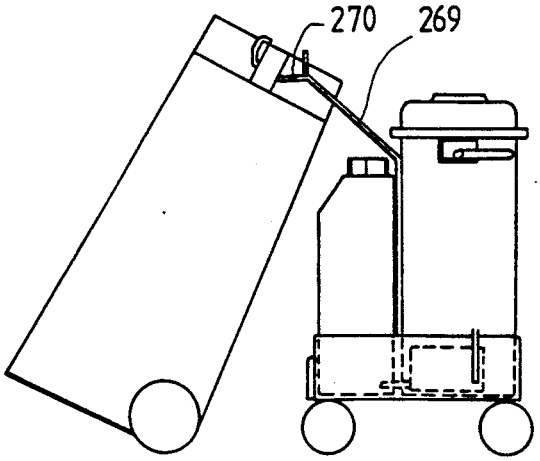
FIG. 14 is a side view of the vacuum cleaner shown in FIG. 13.
Figure 15:
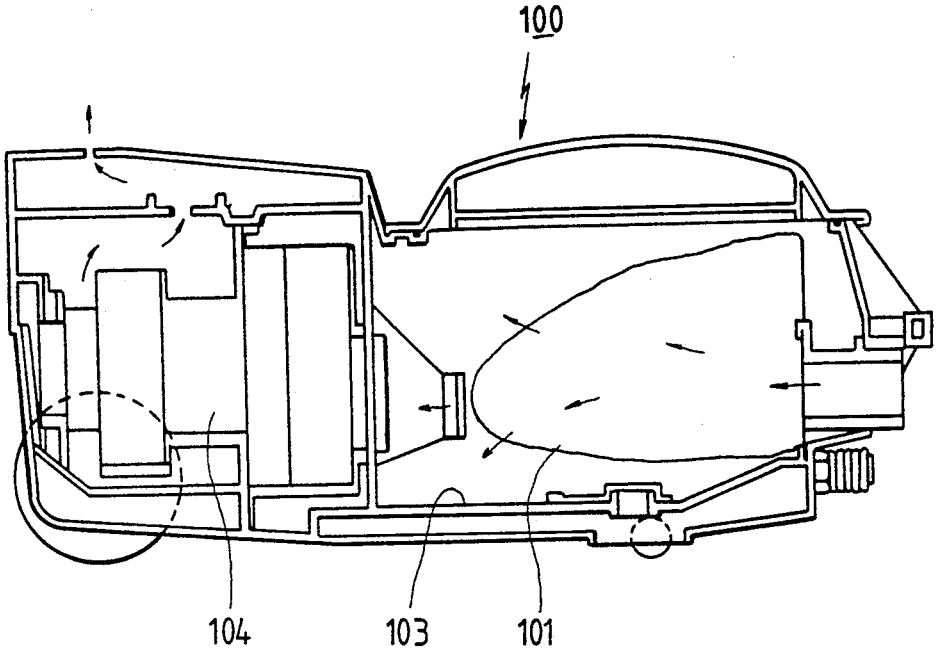
FIG.15 PRIOR ART
FIGS. 15 and 16 are schematic views showing a conventional vacuum cleaner.
Figure 16:
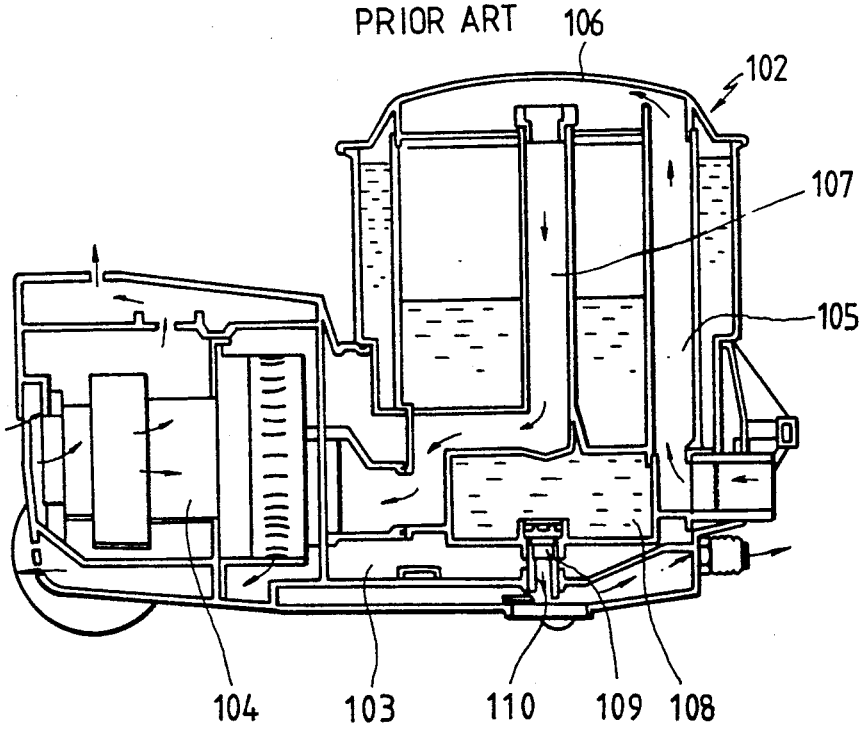
FIG.16 PRIOR ART

FIGS. 13 and 14 illustrate an example of attaching a dry suction cleaning device to the water extraction cleaning device shown in FIG. 11. A hook for the dry suction cleaning device is mounted to the base of water extraction cleaning device and a hook engaging member 270 receiving the hook end of said hook 269 is provided at the upper end of the dry suction cleaning device 269.

As apparent from the above description, the present vacuum cleaner prevents water from coming in toward a motor, that is a suction device and effectively cleans smooth flat floors as well as carpet, when used for water extraction cleaning. In accordance with the present invention, It is possible to provide a vacuum cleaner which can utilize existing dry vacuum cleaners as one of constituting elements of the present invention, without any modification.

What is claimed is:

1. A vacuum cleaner comprising:

a cleaning head including a cleaning head body having front and rear walls, a top wall and opposite side walls, said rear wall being provided with a cleaning head outlet at the center of an upper portion thereof;

a hose assembly provided with an air passage therein and having first and second segments, said first segment connected at one end thereof to said cleaning head outlet;

a liquid detergent tube having one end disposed within the cleaning head;

a dry suction cleaning device connected to one end of said second segment of said hose assembly, a motor generating an air suction force and a filter assembly for filtering dust from air sucked into the interior of said dry suction cleaning device; and a water extraction cleaning device including a water extraction inlet to which the other end of the first segment of the hose assembly is connectable, a water extraction outlet to which the other end of the second segment of the hose assembly is connectable, a main chamber collecting contaminated liquid incoming through said water extraction inlet of the water extraction cleaning device and a liquid detergent chamber connected to the other end of said liquid detergent tube.

2. A vacuum cleaner in accordance with claim 1, wherein said dry suction cleaning device and said water extraction cleaning device are separate devices which are movable individually when connected by said hose assembly.

3. A vacuum cleaner in accordance with claim 1, wherein said cleaning head includes a partition disposed within said cleaning head body to define a cleaning chamber therein and comprised of a cleaning chamber top wall being spaced from said top wall of the cleaning head body to define an air and liquid suction passage therebetween and having a hole receiving said one end of said liquid detergent tube such that said one end of said liquid detergent tube protrudes into the cleaning chamber, cleaning chamber front and rear walls inwardly spaced from said front and rear walls of the cleaning head body, respectively, and cleaning chamber opposite side walls, one being spaced from one side wall of the cleaning head body to define a space therebetween, the other being constituted by a portion of the other side wall of the cleaning head body; a pair of laterally extending air and liquid suction inlets defined between the lower end edge of the front wall of said cleaning head body and the lower end edge of the front wall of said partition and between the lower end of the rear wall of the cleaning head body and the lower end edge of the rear wall partition, respectively; a brush rotatably mounted within the cleaning chamber and having a rotating shaft having one end disposed in said space defined between one side wall of the cleaning head body and one side wall of the partition; a motor disposed directly above said brush and within said air and liquid passage and adapted to generate drive force for rotating the brush, said motor having a drive shaft with one end disposed within the space; and means, adapted for transmitting the drive force of the motor to the brush, provided in the space and operatably connected with both the end of the rotating shaft and the end of the drive shaft.

4. A vacuum cleaner in accordance with claim 3, wherein in order to prevent said cleaning chamber from being under the vacuum condition, a port which connects the chamber to the external atmosphere is provided at the partition side wall constituted by a portion of the side wall of the cleaning head body.

5. A vacuum cleaner in accordance with claim 3, wherein said edges have rubber plates attached which extend over the length of the edges.

6. A vacuum cleaner in accordance with claim 1, wherein said water extraction cleaning device comprises a base; a liquid detergent container closely fitted in said base and having a lower portion defining said liquid detergent chamber, an intermediate portion supporting a support plate for a liquid detergent motor and an upper portion; a main container closely fitted in said upper portion of the liquid detergent container and defining said main chamber collecting contaminated liquid therein; a cover plate separably mounted on the upper end of said main container and provided with a contaminated liquid cover plate inlet; a cover unit disposed on said cover plate and having at its side wall said water extraction inlet of the water extraction cleaning device, said water extraction outlet being disposed opposite to said water extraction inlet; and air-liquid separation means adapted for separating entrained liquid from air incoming through said water extraction inlet.

7. A vacuum cleaner in accordance with claim 6, wherein said air-liquid separation means comprises a deflecting pipe mounted at one end thereof to said inlet of the cover unit and extending toward the center of the interior of the cover unit, said pipe having an upwardly open outlet, an air-liquid separation surface disposed near and directly above the outlet of the deflecting pipe such that air and liquid upwardly projecting through the outlet of deflecting pipe impinge against the air-liquid separation surface, thereby causing entrained liquid droplets to be separated from the incoming air through the water extraction inlet of the cover unit, a second air-liquid separation surface disposed downstream of the first separation surface such that air and liquid past the first separation surface impinge against the second air-liquid separation surface, thereby causing small droplets to be separated from air.

8. A vacuum cleaner in accordance with claim 7, wherein said first air-liquid separation surface comprises a concave bottom of an extension extending downwardly from the inner surface of the top wall of said cover unit and said second air-liquid separation surface comprises a side surface of an extension extending upwardly from the upper surface of said cover plate.

9. A vacuum cleaner in accordance with claim 7, wherein said first air-liquid separation surface is constituted by a portion of the inner surface of the top wall of said cover unit and said second air-liquid separation surface is constituted by a portion of the upper surface of the said cover plate.

10. A vacuum cleaner in accordance with claim 7, wherein said cover plate inlet of the cover plate is disposed directly beneath said outlet of said deflecting pipe.

11. A vacuum cleaner in accordance with claim 6, wherein said air-liquid separation means comprises a deflecting pipe attached to said water extraction inlet of the cover unit and having a downwardly open outlet, a liquid cover plate inlet formed at said cover plate and disposed directly beneath said outlet of the deflecting pipe, and at least one air cover plate outlet formed at the cover plate near said water extraction outlet of said cover unit.

12. A vacuum cleaner in accordance with claim 6, wherein said air-liquid separation means comprises a downwardly extending deflecting pipe having one end connected to said water extraction inlet formed at the top portion of said cover unit and the other end disposed in said main container, and an air discharging pipe having an inlet disposed in the cover unit.

13. A vacuum cleaner in accordance with claim 1, wherein said water extraction device comprises a base, the interior of which is divided by a partition member into a liquid detergent chamber and a liquid detergent pump; a main container closely fitted in the upper portion of said base and defining a main chamber therein; a cover plate separably mounted on the upper end of said main container and provided with a contaminated liquid cover plate inlet; a cover unit disposed on said cover plate and having at its side wall said water extraction inlet of the water extraction cleaning device, said water extraction outlet being disposed opposite to said inlet; and air-liquid separation means adapted for separating entrained liquid from air incoming through said water extraction inlet.

14. A vacuum cleaner in accordance with any one of claims 1 to 13, wherein a filter is attached to said water extraction outlet of the water extraction cleaning device.

15. A vacuum cleaner in accordance with any of the claims 1 to 13, wherein a hook for said dry suction cleaning device is mounted to the base of said water extraction cleaning device and a hook engaging member is provided at the upper end of the dry suction cleaning device.

16. A vacuum cleaner comprising:

a cleaning head including a cleaning head body having front and rear walls, a top wall and opposite side walls, and having a cleaning head outlet providing contaminated liquid as a result of cleaning by the cleaning head;

a water extraction cleaning device including an extraction inlet for receiving contaminated liquid, a main chamber for collecting contaminated liquid, and an extraction outlet for providing dry air after cleaning of the contaminated liquid, and including a liquid detergent chamber for providing liquid detergent;

a dry suction cleaning device including a dry suction inlet, a motor generating air suction at the dry suction inlet, and a filter assembly for filtering air sucked into the dry suction inlet;

a first hose segment connected between the cleaning head output and the extraction inlet for transporting the contaminated liquid from the cleaning head to the extraction unit, a second hose segment connected between the extraction outlet and the dry suction inlet for connecting the dry air from the extraction outlet of the water extraction cleaning device to the dry suction input of the dry suction cleaning device; and a liquid detergent tube connected between the cleaning head and the liquid detergent chamber for providing liquid detergent to the cleaning head.

* * * * *